United States Patent [19]

So et al.

[11] Patent Number: 5,000,389

[45] Date of Patent: Mar. 19, 1991

[54] KEROGEN AGGLOMERATION PROCESS FOR OIL SHALE BENEFICIATION

[75] Inventors: Bernard Y. C. So, Wheaton; Terry L. Marker, Lisle, both of Ill.

[73] Assignee: Amoco Corporation, Chicago, Ill.

[21] Appl. No.: 434,912

[22] Filed: Nov. 9, 1989

[51] Int. Cl.[5] ..... B02C 19/12

[52] U.S. Cl. ..... 241/21; 241/24

[58] Field of Search ..... 44/23, 24; 208/426, 208/427; 75/3; 23/313 R, 314; 241/21, 25, 29, 24

[56] References Cited

U.S. PATENT DOCUMENTS

| | | | |
|---|---|---|---|
| 4,148,710 | 4/1979 | Burton | 208/427 X |
| 4,506,835 | 3/1985 | Tsai | 241/20 |
| 4,528,090 | 7/1985 | Tsui | 241/24 X |
| 4,673,133 | 6/1987 | Datta et al. | 241/20 X |

*Primary Examiner*—Mark Rosenbaum

*Attorney, Agent, or Firm*—Reginald K. Taylor; William H. Magidson; Ralph C. Medhurst

[57] ABSTRACT

In a kerogen agglomeration process, a substantial amount of the oil shale is comminuted to a top size greater than about 0.4 to 8 in. prior to kerogen agglomeration. Kerogen agglomeration includes comminuting the oil shale in the presence of an added organic liquid and water to form kerogen-rich agglomerates and mineral-rich particles.

17 Claims, No Drawings

KEROGEN AGGLOMERATION PROCESS FOR OIL SHALE BENEFICIATION

FIELD OF THE INVENTION

The present invention is a method of beneficiating oil shale to reduce kerogen processing costs. More specifically, the present invention beneficiates the shale using a kerogen agglomeration process that requires less energy input than previous kerogen agglomeration methods.

BACKGROUND OF THE INVENTION

In view of the recent instability of the price of crude oil and natural gas, there has been renewed interest in alternate sources of energy and hydrocarbons. Much of this interest has been centered on recovering hydrocarbons from solid hydrocarbon-containing material such as oil shale, coal, and tar sands by pyrolysis or upon gasification to convert the solid hydrocarbon-containing material into more readily usable gaseous and liquid hydrocarbons.

Vast reserves of hydrocarbons in the form of oil shales exist throughout the United States. The Green River formation of Colorado, Utah, and Wyoming is a particularly rich deposit and includes an area in excess of 16,000 square miles. It has been estimated that an equivalent of 7 trillion barrels of oil are contained in oil shale deposits in the United States, almost sixty percent located in the Green River oil shale deposits. The remainder is largely contained in the leaner Devonian-Mississippi black shale deposits which underlie most of the eastern part of the United States.

Oil shales are sedimentary inorganic materials that contain appreciable organic material in the form of high molecular weight polymers. The inorganic part of the oil shale is marlstone-type sedimentary rock. Most of the organic material is present as kerogen, a solid, high molecular weight, three-dimensional polymer which has limited solubility in ordinary solvents and therefore cannot be readily recovered by simple extraction.

A typical Green River oil shale is comprised of approximately 85 weight percent mineral components, of which carbonates are the predominate species. Lesser amounts of feldspars, quartz, and clays are also present. The kerogen component represents essentially all of the organic material. A typical elemental analysis for Green River oil shale kerogen is approximately 78 weight percent carbon, 10 weight percent hydrogen, 2 weight percent nitrogen, 1 weight percent sulfur, and 9 weight percent oxygen.

Most of the methods for recovering kerogen from oil shale involve mining the oil shale, grinding it, and thermally decomposing (retorting) the ground oil shale. In view of the fact that approximately 85 weight percent of the oil shale is mineral components, unless something is done to remove these minerals, most of the oil shale which is fed, heated up, and circulated in a retort is composed of material that cannot produce oil. This high percentage of inorganic material significantly interferes with subsequent shale processing to recover the kerogen. For example, in retorting the shale, either large or numerous retorts are needed to process the commercial quantities involved. Moreover, a substantial amount of heat is expended and lost in heating up the inorganic minerals to retorting temperatures and cooling them back down again.

Another problem associated with the presence of a large amount of mineral matter in the oil shale is pollution. In the retorting process, contaminating fines are produced and must be disposed of. The greater the quantity of minerals, the greater the quantity of polluting fines. Another source of pollution is the spent shale recovered from the retort. During retorting, chemical reactions occur in the shale as the kerogen is volatized. This results in a residue of chemical compounds. Such compounds can present a hazard in surface water pollution after they have been discarded.

As a result of the problems associated with the high percentage of minerals in oil shale, it can be economically beneficial to reject these minerals prior to retorting. This is called "shale beneficiation." This beneficiation is basically divided into two steps: (1) liberating the kerogen from the mineral matter, and (2) separating the kerogen from the mineral matter.

An essential part of liberating the kerogen from the mineral matter is comminuting the oil shale. There are several options for comminuting the oil shale. Hazemag mills, semi-autogenous (SAG) mills, balls mills, and tower mills can be effective equipment for comminution. The number of comminuting stages and the selection of the most efficient mill depends upon the intrinsic grain size of the kerogen and the extent of kerogen liberation required.

In a SAG mill, which is a cascade mill in which about 10 volume percent steel balls supplement the oil shale solid feed as comminution media, the shale can be comminuted down to about $\frac{1}{2}$ in. top size. A ball mill, which is a tumbling mill using about 50 volume percent steel balls as comminuting media, can comminute the shale down to about 0.003 in. top size. To obtain a top size of less than 0.003 in., a tower mill can be used. A tower mill is a stirred ball mill that uses attrition as the mechanism for size reduction.

After comminuting the oil shale to produce kerogen-rich particles and mineral-rich particles, the second step of beneficiation is separating these particles from each other. The two basic methods of making the kerogen-rich/mineral-rich particle separation are chemical and physical separation.

Chemical separation includes leaching of minerals, such as acid leaching of carbonates, or extraction of kerogen by chemically breaking the kerogen bonds. U.S. Pat. Nos. 4,176,042 and 4,668,380 are examples of chemical beneficiation.

One type of physical separation is density separation. This type of physical separation is possible because kerogen has a specific gravity of about 1 gm/cm$^3$ and because mineral components in oil shale have a density of about 2.8 gm/cm$^3$. One type of density separation is heavy media cyclone separation. Heavy media cyclone is a process for separating, by density, relatively coarse shale particles. An example of a heavy media separation process can be found in U.S. Pat. No. 4,528,090. In general, the aim of heavy media separation is to separate shale into a kerogen-rich fraction having low density and a kerogen-lean fraction having high density. The liquid medium used is a mixture of water and finely ground magnetite and ferrosilicon. By varying the concentration of the magnetite and ferrosilicon, the medium can be made to have a density from 1.8–2.4 gm/cm$^2$ so that the shale can be split at the density required. The kerogen-rich material floats to the top and is taken overhead, and the kerogen-lean material goes into the underflow from the cyclone. The disadvantages of this process are that it relies upon an inherent natural heterogeneity among oil shale particles and that it has not been successful in separating small oil shale particles.

Another type of physical separation is surface property separation. An example of surface property separation is froth flotation. In the froth flotation process, oil shale particles are mixed with an aerated aqueous solution. Since the kerogen-rich particles have greater hydrophobic character than mineral-rich particles, the kerogen-rich particles preferably attach onto air bubbles, thereby causing the kerogen-rich particles to float. Subsequently, the froth containing these kerogen-rich particles is removed. Additives can be used to improve kerogen grade and recovery. One disadvantage of the froth flotation process is the oil shale is required to be comminuted to a fine particle size prior to froth flotation. Another disadvantage of this process is that the effects of different types of collectors, frothers, and dispersants are difficult to predict. In addition, floated, kerogen-enriched shale has a tendency to have a higher concentration of carbonates than starting shale. An example of a froth floation process is disclosed in U.S. Pat. No. 4,673,133.

Another example of surface property separation is selective agglomeration. Selective agglomeration is the combination or aggregation of specific particles into clusters of approximately spherical shape. Selective agglomeration of coal fines is known in the art. Selective agglomeration of high-rank coals using high-quality oils is disclosed in U.S. Pat. Nos. 4,209,301 and 4,153,419. U.S. Pat. No. 4,726,810 discloses a process for selectively agglomerating low-rank sub-bituminous coals using low-quality oil. The difference between the methods disclosed in these patents and the instant invention is that the instant invention selectively agglomerates oil shale rather than coal. Because of the difference in chemistry of oil shale and coal, the methods of selective agglomeration must be different. Coal is typically precomminuted in water; however, precomminuting oil shale in water will interfere with the selective agglomeration of the kerogen.

A form of selective agglomeration used for beneficiating oil shale is kerogen agglomeration. In kerogen agglomeration, shale particles are mixed with an organic liquid and water to form agglomerates of the kerogen-rich particles while the mineral-rich particles disperse into a water phase.

In Reisberg, J., "Beneficiation of Green River Shale by Pelletization," *American Chemical Society* (ASCMC8), V. 163 (Oil Shale, Tar Sands, and Related Materials), pp. 165–166, 1981, ISSN 00976156, a form of kerogen agglomeration of oil shale is disclosed. This reference describes precomminuting the shale to a size small enough to pass through a screen size of 0.0059 in. (100 mesh). This shale is subsequently comminuted in the presence of heptane and water to form a kerogen-enriched fraction in the form of discrete pellets and a mineral-rich fraction dispersed in an aqueous phase. These pellets are subsequently separated from the aqueous phase using sieves. This process was found to be uneconomical due to the major cost of the power used to pregrind the oil shale prior to kerogen agglomeration. An estimated total comminution power input for this process is 130 Kw-hr/ton of shale.

The Reisberg reference's requirement that the shale be precomminuted to less than 0.0059 in. (100 mesh) prior to kerogen agglomeration is illustrative of the commonly held belief that in order to form agglomerates the shale must be finely precomminuted or prepulverized prior to kerogen agglomeration. Another example of this requirement can be found in U.S. Pat. No. 4,506,835.

The cost of comminuting the oil shale to a fine size prior to kerogen agglomeration has been a major impediment to the development of a commercial kerogen agglomeration process. There is a need for a commercially viable kerogen agglomeration process that separates kerogen from minerals without comminuting the oil shale to a fine size prior to kerogen agglomeration.

SUMMARY OF INVENTION

In its broadest aspect, the present invention is a kerogen agglomeration method for beneficiating raw oil shale. In the first step of this invention, a substantial portion of the oil shale is comminuted to a top size of greater than about 0.4 in. Next, the oil shale is comminuted with a multiphase liquid comprising an added organic liquid and water to form kerogen-rich agglomerates and mineral-rich particles dispersed in water. The kerogen-rich agglomerates are then separated from the mineral-rich particles. The use of this method can result in a reduction in the total power cost of beneficiating the oil shale while maintaining about the same separation efficiency as methods having higher comminution costs.

In a first embodiment, the first step is to comminute a substantial portion of the oil shale to a top size of greater than about 1 in. Next, the oil shale is comminuted in the presence of a two-phase liquid consisting essentially of an added hydrocarbon liquid and water to form kerogen-rich agglomerates and mineral-rich particles dispersed in water. The kerogen-rich agglomerates are then separated from the mineral-rich particles using at least one screen. The screen should have a size that prevents the passage of the kerogen-rich agglomerates but allows the passage of the mineral-rich particles that are dispersed in the water phase. The size of the kerogen-rich agglomerates is greater than the size the mineral-rich particles.

In another embodiment, the first step is to comminute a substantial portion of the oil shale to a top size of greater than about 8 in. Next, the oil shale is comminuted in the presence of added shale oil and water at a power input of about 1–50 Kw-hr/ton of shale to form kerogen-rich agglomerates and mineral-rich particles dispersed in water. The shale is present at a shale oil to oil shale ratio of about 0.1–1. The shale oil to water ratio is about 0.3–1.3. The kerogen-rich agglomerates are then separated from the mineral-rich particles using at least one screen having a screen size of about 0.0117–0.0015 in.

DESCRIPTION OF THE PREFERRED EMBODIMENT

The starting material for the present invention is raw oil shale which has been mined using conventional techniques. A shale suitable for use in this invention can be characterized as having the following make up: about 6–30 weight percent kerogen, about 40–50 weight percent silicates and clays, about 22 to 42 weight percent carbonates, about 0–10 weight percent dawsonites, and about 0–12 weight percent nacholites. Mineralogy can have an effect on kerogen agglomeration. For example, shale abundant in silicates, zeolites, clays and dawsonites are generally easier to beneficiate by kerogen agglomeration than shales with an abundance of siderite, pyrite, ankerite, dolomite, and calcite. A shale grade suitable for use in this invention ranges from about 6–30 weight percent kerogen. Shale grade can also have an affect on kerogen agglomeration. For example, in Mahogany shale, percent mineral rejection and percent product improvement decreases with increasing shale grade for a given mineral composition. Percent mineral rejection is defined as the difference between the weight of mineral in the feed and the weight of minerals in the product divided by the weight of minerals in the feed (X 100). Percent product improvement is defined as the difference between the product grade and the feed grade divided by the feed grade (X 100).

After mining the oil shale, the next step is to initially comminute the oil shale. Applicants have discovered that, contrary to prior teachings relating to kerogen agglomeration, it is not necessary to comminute the oil shale to a fine top size prior to kerogen agglomeration in order to form kerogen-rich agglomerates. An essential feature of the present invention is, prior to kerogen agglomeration, comminuting a substantial portion of the oil shale to a top size of greater than 0.4 in., preferably greater than 1 in., more preferably greater than 4 in., and even more preferably greater than 8 in. Substantial portion is defined as greater than about 80 percent of the desired top size, preferably greater than about 90 percent of the desired top size, more preferably greater than about 99 percent of the desired top size. Due to equipment limitations, a practical maximum top size of the oil shale can be about 18 in.

The term "comminuting" is defined as reducing the size of oil shale particles. This term is intended to encompass any method of reducing the size of the oil shale, including but not limited to, mining, eroding, crushing, grinding, and pulverizing the oil shale. Equipment suitable for use in comminuting the oil shale includes, but is not limited to, tooth crushers, gyro crushers, hammer mills, semi-autogeneous (SAG) mills, ball mills, and tower mills. The number and type of mill selected will depend upon the intrinsic grain size of the kerogen, the extent of kerogen liberation required, and the throughput. The comminution scheme can be closed or open loop.

Kerogen agglomeration with comminution is the next step. Kerogen agglomeration is based on the difference in surface properties between kerogen and minerals. Kerogen agglomeration comprises contacting oil shale particles with a two-phase liquid mixture of water and an added organic liquid to form kerogen-rich agglomerates and mineral-rich particles dispersed in water. Kerogen-rich particles tend to form an aggregate of particles clustered into approximately a spherical shape (kerogen-rich agglomerates). Mineral-rich particles do not agglomerate in either phase but tend to form a dispersion in the aqueous phase.

In the present invention, after the initial comminution of the oil shale, it is necessary to further comminute the oil shale particles during the kerogen agglomeration step. The organic liquid is not intended to be kerogen that is liberated from the oil shale itself, but rather is intended to be an organic liquid that is in addition to such kerogen. Comminuting the oil shale particles during kerogen agglomeration results in a better dispersion of the mineral-rich particles in the water. Comminution can be accomplished with a SAG mill, possibly followed by a ball mill or a stirred ball mill. The comminution scheme during kerogen agglomeration can be closed or open loop. The power input required to properly comminute the shale during kerogen agglomeration ranges from about 1–50 Kw-hr/ton, preferably from about 1–25 Kw-hr/ton. The organic liquid can be defined as a hydrocarbon liquid with a boiling point from about 150–1300 deg. F., preferably from about 150–500 deg. F. The water can be fresh water or salt water. A suitable organic liquid to shale ratio for the present invention can be about 0.1 to 1.0. A suitable organic liquid to water ratio can be about 0.3 to 1.3, preferably about 0.44. A suitable amount of oil shale solids in the kerogen agglomeration step of the present invention can be about 25 to 75 weight percent of the oil shale plus liquids, preferably about 53 percent. A suitable minimum agglomerate size for the present invention can be about 0.0117 in. (48 mesh) to 0.0015 in. (400 mesh). A suitable temperature for the kerogen agglomeration step can be ambient to about 200 deg. F.

If too much organic liquid is added in the shale, unstable agglomerates can be formed resulting in poor separation of the kerogen-rich particles and the mineral rich particles. Poor separation can also result from adding too little water because there would not be enough medium for rejecting the fines. Too little organic liquid added in the shale can result in not enough agglomerates being formed. Too much water can result in comminution inefficiencies.

In the separation step, it is important to note that, depending on the extent of comminution occurring during the kerogen agglomeration step, there can be coarse shale particles which are not dispersed in the water. Therefore in the separation step, the mineral-rich particles dispersed in water can be separated from the kerogen-rich agglomerates and coarse shale particles. Means suitable for use in this separation include cyclones, flotation equipment, and screens having a screen size of from about 0.0117 in. to 0.0015 in.

EXAMPLES

A Mahogany shale having a grade of 21 gal/ton (GPT) was tested to determine what effects comminuting the oil shale prior to kerogen agglomeration have on the separation efficiency and power input requirements of the shale.

There were a total of 5 tests. Each test represents a particular top size the shale was comminuted to prior to kerogen agglomeration. The feed for the tests ranged from pulverized oil shale of 0.006 in. top size to mined oil shale of 8 in. top size. In each test, the percent product improvement, percent organic recovery, separation efficiency, and comminution power input were determined. Percent improvement was defined as the difference between the product grade and the feed grade divided by the feed grade (X 100). Percent organic recovery was defined as the weight of kerogen in the product divided by the weight of kerogen in the feed (X 100). Separation efficiency was defined as the difference between the recovery of organics in the product stream and the recovery of inorganics in the product stream. The comminution power input for comminution was separated into the power used prior to kerogen agglomeration and the power used during kerogen agglomeration.

In test 4, the oil shale was initially dry comminuted in a continuous SAG mill, and kerogen-agglomerated in a batch ball mill. In test 1–3, the product from the continuous SAG mill was dry comminuted in a continuous ball mill to 0.006 in. for test 1, 0.028 in. for test 2, and 0.039 in. for test 3. Then the kerogen was agglomerated in a batch ball mill in tests 1–3. In test 5, the comminution that occured prior to kerogen agglomeration resulted from mining the oil shale followed by crushing with a tooth crusher. Kerogen agglomeration in test 5 was then done in a continuous SAG mill. For the batch agglomeration tests (1–4), the oil shale was wet with Norpar 12 prior to the addition of water. Norpar 12 is a commercially available product made up of the following components: 8.5 percent N-$C_{10}$, 45.5 percent N-$C_{11}$, 41.8 percent N-$C_{12}$, and 5.2 percent N-$C_{13}$. For test 5, during the kerogen agglomeration step, the oil shale was contacted with Norpar 12 as it was introduced into the SAG mill.

In each test, the kerogen-rich product was larger than 0.0017 in. (325 mesh) and the mineral reject was smaller than 0.0017 in.

The results of these tests are shown in Table 1. These results show that similar separation efficiencies can be obtained at lower power input by minimizing dry pre-comminution.

TABLE 1

| Test No. | Top Size (in.) | % Improvement | Wt % Organic Recovery | Separation Efficiency |
|---|---|---|---|---|
| 1 | 0.006 | 24 | 97 | 21 |
| 2 | 0.028 | 24 | 97 | 21 |
| 3 | 0.039 | 25 | 96 | 22 |
| 4 | 0.374 | 25 | 95 | 22 |
| 5 | 8.0 | 32 | 75 | 21 |

| Test No. | Comm. Power Input Before Kerogen Aggl. (Kw-hr/ton) | Comm. Power Input After Kerogen Aggl. (Kw-hr/ton) | Total Comm. Power Input (Kw-hr/ton) |
|---|---|---|---|
| 1 | 29.3 | 16.8 | 46.1 |
| 2 | 14.0 | 16.8 | 30.8 |
| 3 | 12.4 | 16.8 | 29.2 |
| 4 | 8.0 | 16.8 | 24.8 |
| 5 | 0.0 | 12.6 | 12.6 |

That which is claimed is:

1. A kerogen agglomeration method for beneficiating raw oil shale, comprising the steps of (a) comminuting a substantial portion of the oil shale to a top size of greater than about 1 in.;

(b) comminuting the oil shale in the presence of a two-phase liquid consisting essentially of an added hydrocarbon liquid and water to form kerogen-rich agglomerates and mineral-rich particles dispersed in water; and (c) separating the kerogen-rich agglomerates from the mineral-rich particles at a separation efficiency of at least about 21 using at least one screen, said screen having a size that prevents passage of the kerogen-rich agglomerates but allows passage of the mineral-rich particles dispersed in a water phase.

2. A method of claim 1 wherein in step (a) a substantial portion of the oil shale is comminuted to a top size greater portion than about 4 in.

3. A method of claim 1 wherein in step (a) a substantial portion of the oil shale is comminuted to a top size greater than about 8 in.

4. A method of claim 1 wherein the hydrocarbon liquid has a boiling point from about 150–1300 deg. F.

5. A method of claim 4 wherein the hydrocarbon liquid comprises a petroleum fraction.

6. A method of claim 4 wherein the hydrocarbon liquid comprises a shale oil.

7. A method of claim 1 wherein in step (b) there is a hydrocarbon liquid to shale ratio of about 0.1–1.

8. A method of claim 1 wherein in step (b) there is a hydrocarbon liquid to water ratio of about 0.3–1.3.

9. A method of claim 1 wherein in step (b) there is a power input of about 1–50 Kw-hr/ton of shale.

10. A method of claim 1 wherein in step (c) the screen has a screen size of about 0.0117–0.0015 in.

11. A method of claim 1 wherein in step (a) substantial portion is greater than about 80 percent.

12. A method of claim 1 wherein in step (a) substantial portion is greater than about 90 percent.

13. A method of claim 1 wherein in step (a) substantial portion is greater than about 99 percent.

14. A kerogen agglomeration method of beneficiating raw oil shale, comprising the steps of:

(a) comminuting a substantial portion of the oil shale to a top size greater than about 8 in.;

(b) comminuting the oil shale in the presence of added shale oil and water at an energy input of about 1–50 kw-hr/ton of shale to form kerogen-rich agglomerates and mineral-rich particles dispersed in water, the shale being present at a shale oil to oil shale ratio of about 0.1–1, the water being present at a shale oil to water ratio of about 0.3–1.3; and (c) separating the kerogen-rich agglomerates from the mineral-rich particles at a separation efficiency of at least about 21 utilizing a screen having a screen size of about 0.0117–0.0015 in.

15. A method of claim 14 wherein in step (a) substantial portion is greater than about 80 percent.

16. A method of claim 14 wherein in step (a) substantial portion is greater than about 90 percent.

17. A method of claim 14 wherein in step (a) substantial portion is greater than about 99 percent.

* * * * *